US007627269B2

(12) United States Patent
Matsuguma et al.

(10) Patent No.: US 7,627,269 B2
(45) Date of Patent: Dec. 1, 2009

(54) IMAGE FORMING APPARATUS WITH CHARGING MEMBER CLEANING CAPABILITIES

(75) Inventors: Minoru Matsuguma, Suntoh-gun (JP); Kenji Matsuda, Numazu (JP); Masaki Ojima, Mishima (JP); Katsuhiro Kojima, Mishima (JP); Hideki Matsumoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 11/395,127

(22) Filed: Apr. 3, 2006

(65) Prior Publication Data

US 2006/0222400 A1 Oct. 5, 2006

(30) Foreign Application Priority Data

Apr. 4, 2005 (JP) ..... 2005-107435
Mar. 9, 2006 (JP) ..... 2006-063956

(51) Int. Cl.
*G03G 21/00* (2006.01)

(52) U.S. Cl. ..... 399/129; 399/149; 399/150

(58) Field of Classification Search ..... 399/100, 399/129, 149, 150

See application file for complete search history.

(56) References Cited

U.S. PATENT DOCUMENTS 5,732,310 A * 3/1998 Hiroshima et al. ..... 399/101
6,006,055 A 12/1999 Furuya ..... 399/149
2004/0223784 A1* 11/2004 Nakahara et al. ..... 399/129

FOREIGN PATENT DOCUMENTS

JP 07-219313 8/1995
JP 2003-302816 10/2003

* cited by examiner

*Primary Examiner*—David M Gray
*Assistant Examiner*—Bryan P Ready
(74) *Attorney, Agent, or Firm*—Fitzpatrick, Cella, Harper & Scinto

(57) ABSTRACT

An image forming apparatus includes an image bearing member; a charging member for contacting a peripheral surface of the image bearing member to electrically charge the peripheral surface; a first developing device for forming a first developed image on the peripheral surface of the image bearing member charged by the charging member; a second developing device for forming a second developed image on the peripheral surface, wherein a combined developed image is formed by superimposing the first developed image and the second developed image on a common transfer material, wherein when the combined image is being formed, the charging member is cleaned by transferring, by an electric field, material deposited on the charging member to a region between the first developed image and the second developed image on the peripheral surface of the image bearing member, and wherein the first developed image and the second developed image are not formed in the region.

18 Claims, 6 Drawing Sheets

IMAGE FORMING APPARATUS WITH CHARGING MEMBER CLEANING CAPABILITIES

FIELD OF THE INVENTION AND RELATED ART

The present invention relates to an image forming apparatus such as a copying machine, a printer, etc.

First, an image forming apparatus which forms a full-color image by placing multiple monochromatic toner images different in color in layers will be described. The image forming process of such an image forming apparatus is as follows: Based on the data of an image to be formed, the optical image of the full-color image to be formed is separated into four optical monochromatic images four primary colors, that is, yellow, magenta, cyan, and black colors, one for one. Then, a charging step, an exposing step, and a developing step are sequentially carried out for each of the four primary colors, sequentially forming yellow, magenta, cyan, and black toner images (developer images), on the peripheral surfaces of an electrophotographic photosensitive member (which hereinafter will be referred to as photosensitive drum) as an image bearing member in the form of a drum. These toner images are sequentially transferred (primary transfer) in layers onto an intermediary transfer medium, effecting a full-color image. Then, the layered toner images are transferred (secondary transfer) onto a transfer medium such as a piece of paper. Thereafter, the transfer medium is subjected to heat and pressure in a fixing apparatus to fix the unfixed toner images on the transfer medium. The toner and foreign substances remaining on the peripheral surface of the photosensitive drum after the primary transfer are scraped away by the cleaning blade or the like of a cleaning apparatus, preparing thereby the photosensitive drum for the following image formation. The toner and the foreign substances scraped away from the peripheral surface of the photosensitive drum are recovered into a waste toner bin.

As a charging member for charging the peripheral surface of a photosensitive drum, an elastic roller (which hereinafter will be referred to as charge roller) which has a metallic core is employed. A charge roller is placed in contact with the photosensitive drum. The peripheral surface of the photosensitive drum is charged by applying DC bias or the combination of DC and AC biases to the charge roller which is in contact with the peripheral surface of the photosensitive drum. This method of charging the peripheral surface of a photosensitive drum, which is referred to as the contact charging method, is widely used because it is smaller in the amount of the contamination of a photosensitive drum attributable to ozone and nitrogen oxides.

The contact charging method, however, suffers from the following fault. That is, in the contact charging method, a charge roller is placed in contact with a photosensitive drum. Therefore, the portion of the toner on the peripheral surface of the photosensitive drum, which slipped through a cleaning apparatus, sometimes adheres to the peripheral surface of the charge roller, along with foreign substances such as the toner scattered from a developing device. This adhesion of the toner and the like to the peripheral surface of the charge roller can cause the charge roller to fail to satisfactorily charge the photosensitive drum, which results in the formation of an inferior image.

For the reason given above or the like, there have been made various proposals for removing the toner and other foreign substances having adhered to the peripheral surface of a charge roller. For example, it has been proposed to place a cleaning member in contact with a charge roller.

There has also been proposed a charge roller cleaning method which returns the toner having adhered to a charge roller to a photosensitive drum, by controlling in potential level the voltage applied to the charge roller.

However, the above-described methods suffer from the following problems. That is, in these cleaning methods, generally, a photosensitive drum is cleaned immediately before the formation of every monochromatic toner image, or every preset number of transfer mediums fed into an image forming apparatus for image transfer. Therefore, in the case of an image forming apparatus in accordance with the prior art, in which four monochromatic toner images different in color are sequentially transferred in layers onto the intermediary transfer member to form each full-color image, the amount of the toner and other foreign substances on the peripheral surface of the charge roller gradually increases. That is, the amount of the toner and other foreign substances on the charge roller after the charging of a photosensitive drum for forming the monochromatic toner image of the second color is greater than that after the charging of the photosensitive drum for forming the monochromatic toner image of the first color, and the amount of the toner and other foreign substances on the charge roller after the charging of the photosensitive drum for forming the monochromatic toner image of the third color is greater than that after the charging of the photosensitive drum for forming the monochromatic toner image of the second color, and so on. Further, it was possible that a charge roller gradually would decline in charging performance while the monochromatic toner images were sequentially formed for one page of transfer medium. Moreover, if the area of the peripheral surface of the photosensitive drum, onto which the foreign substances were expelled by the charge roller cleaning operation, overlapped with the area of the peripheral surface of the photosensitive drum, across which a developer image was formed during the following rotation of the photosensitive drum, it was possible that an inferior image would be effected by the foreign substances.

SUMMARY OF THE INVENTION

Thus, the primary object of the present invention is to provide an image forming apparatus for forming a full-color image on a transfer medium, which is stable in the potential level to which its charging members charge corresponding photosensitive drums.

Another object of the present invention is to provide an image forming apparatus for forming a full-color image on a transfer medium, which is higher in image quality than an image forming apparatus, in accordance with the prior art, for forming a full-color image on a transfer medium.

According to the present invention, a charging member can be kept free of adherent substances such as developer and foreign substances, by the operation for cleaning the charging member. With the charging member being kept free of the adherent substances, the charging member remains consistent in charging performance. Also according to the present invention, the operation for cleaning a charging member can be prevented from affecting the developer image formation area of the peripheral surface of an image bearing member, and therefore, it is possible to raise the level of quality at which a full-color image is formed to be transferred onto a recording medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

[General Structure of Image Forming Apparatus]

Figure 1:
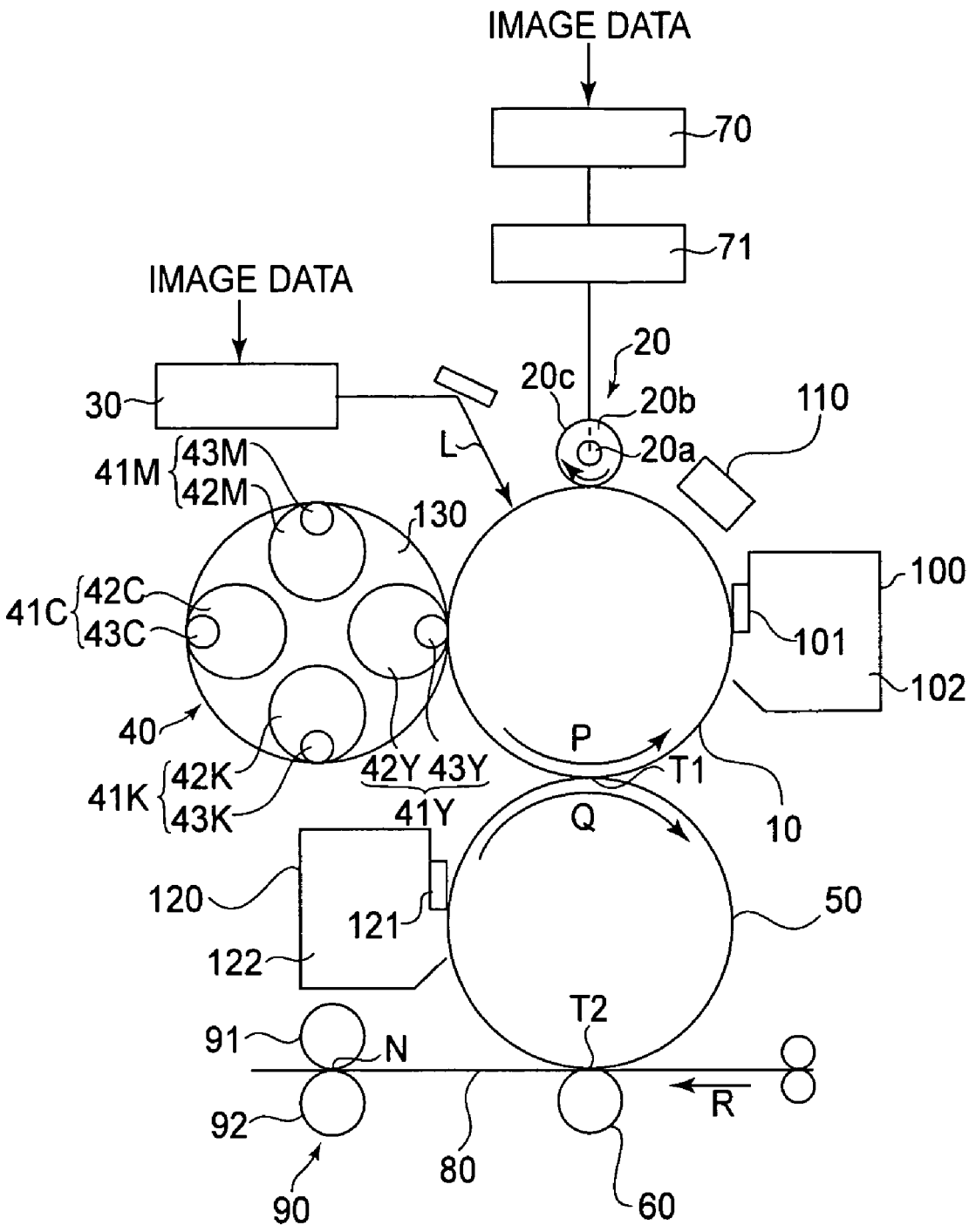
FIG. 1 is a schematic drawing of the image forming apparatus in a first embodiment of the present invention.

FIG. 1 is a schematic drawing of the image forming apparatus in a first embodiment of the present invention.

The general structure and operation of the image forming apparatus in this embodiment are as follows. The image forming apparatus is connected to an unshown host device such as a personal computer, a workstation, and the like. In response to a print demand from the host device, a charge control portion (CPU) 70 as a charge controlling means, and an exposing apparatus 30, each receives image data from the host device through a video interface (unshown). From these image data, the information for forming yellow (Y), magenta (M), cyan (C), and black (K) monochromatic toner images, of which an intended full color image will be made. Then, the charging and exposing processes are carried out for forming each of the monochromatic toner images different in color. The electrostatic latent images sequentially formed through the exposing processes are sequentially developed, sequentially forming monochromatic toner images different in color on the photosensitive drum 10 as an image bearing member. The toner images are sequentially transferred (primary transfer) in layers onto an intermediary transfer member 50. Then, the toner images are transferred (secondary transfer) all at once onto a transfer medium 80 such as a sheet of paper, causing the transfer medium 80 to bear a full color image.

[Detailed Description of Apparatus Structure]

As the photosensitive drum 10 as an image bearing member, a photosensitive member made up of an aluminum cylinder, which is 130 mm in external diameter (roughly 408 mm in circumference), and a photosensitive layer formed of organic photosensitive substance on the peripheral surface of the aluminum cylinder, is employed. The photosensitive drum 10 is rotationally driven by a driving system (unshown) at a preset peripheral velocity (process speed) of 100 mm/sec in the clockwise direction indicated by an arrow mark P.

As the transfer member 80, a transfer member of the letter size, which is 11 inches (roughly 280 mm) long in terms of transfer member conveyance direction R (sheet conveyance direction), is used.

As the charge roller 20 as a charging member, a roller made up of an electrically conductive metallic core 20*a*; a rubber layer 20*b* formed on the peripheral surface of the metallic core 20*a*; and a protective layer 20*c* as the surface layer, is employed. The rubber layer 20*b* is formed of foamed rubber, and its electrical resistance is in the medium range. The charge roller 20 is 8 mm in diameter (circumference: roughly 44 mm). The charge roller 20 is kept pressed toward the photosensitive drum 10 by a pressure applying means (unshown) which applies pressure to the lengthwise ends of the metallic core 20*a*of the charge roller 20, so that the peripheral surface of the protective layer 20*c* of the charge roller (which hereinafter may be referred to as peripheral surface of charge roller 20) is kept pressed upon the peripheral surface of the photosensitive drum 10. The charge roller 20 is rotated by the rotation of the photosensitive drum 10. To the metallic core 20*a*, DC bias (charge bias) is applied from a charge bias application power source 71 as a bias applying apparatus. As the charge bias is applied to the charge roller 20, which is being rotated by the rotation of the photosensitive drum 10, the peripheral surface of the photosensitive drum 10 is uniformly charged to preset potential level, which corresponds to the potential level of the charge bias (DC bias). Regarding the method for charging the photosensitive drum 10 by applying DC bias to the charge roller, it is common practice that the potential level of the charge bias applied to the charge roller 20 is rendered roughly 500 V higher than the desired potential level to which the peripheral surface of the photosensitive drum 10 is to be charged, although the difference is to be adjusted depending on the material and thickness of the photosensitive layer of photosensitive drum 10, the ambient conditions of the image forming apparatus, more specifically, the temperature and humidity of the environment in which the apparatus is operated.

The value of the bias applied to the charge roller 20, and the method for controlling the bias, will be described later.

The exposing apparatus 30 is a laser scanner (exposing apparatus which scans object with a beam of laser light). It scans (exposes) the uniformly charged portion of the peripheral surface of the rotating photosensitive drum 10, with a beam of laser light L which it projects while modulating the beam of laser light L with the above-mentioned image information. As a result, an electrostatic latent image, which reflects the pattern in which the peripheral surface of the photosensitive drum 10 has just been exposed, emerges on the peripheral surface of the photosensitive drum 10.

Designated by a referential symbol 40 is a development unit of the rotary type. A rotary 130, that is, a rotatable supporting apparatus for supporting multiple developing apparatuses, holds developing apparatuses 41Y, 41M, 41C, and 41K, which contain yellow, magenta, cyan, and black toners, respectively. Each toner is nonmagnetic toner made up of a single component. As the toners, negative toners, that is, toners characterized in that they are negative in the polarity to which they are inherently charged, are used. The developing apparatuses 41 are provided with development rollers 43 (43Y, 43M, 43C, and 43K) disposed in the corresponding developing devices 42 (42Y, 42M, 42C, and 42K) in which yellow, magenta, cyan, and black toners are stored, respectively. The developing method used in this embodiment is as follows: A preselected developing device 42 (42Y, 42M, 42C, or 42K) is moved into the position in which it directly opposes the peripheral surface of the photosensitive drum 10, by rotating the rotary 130. Then, the electrostatic latent image on the photosensitive drum 10 is developed by transferring toner with the use of the alternating magnetic field generated by applying the combination of DC and AC voltages as bias (development bias) to the development roller 43.

As the intermediary transfer member 50, a roller made up of an aluminum cylinder, an electrically conductive elastic layer formed on the peripheral surface of the aluminum cylinder, of NBR in which carbon has been dispersed, and a surface layer formed on the peripheral surface of the electrically conductive elastic layer, of the urethane resin in which fluorinated resin or the like has been dispersed to give the surface layer mold releasing property, is used. The roller is adjusted in volumetric resistivity so that its volumetric resistivity is in the range of 105-1010 ohm·cm. The external diameter (circumference) of the intermediary transfer member 50 is the same as that of the photosensitive drum 10. The intermediary transfer member 50 is kept pressed upon the photosensitive drum 10 with the application of a preset amount of pressure, forming a primary transfer nip T1 between itself and photosensitive drum 10. The intermediary transfer member 50 is rotationally driven in the clockwise direction indicated by an arrow mark Q at the same peripheral velocity as that of the photosensitive drum 10. To the intermediary transfer member 50, a preset voltage (transfer bias) which is opposite in polarity to the toner is applied.

Designated by a referential symbol 110 is a charge removing apparatus.

The image forming sequence carried out by the image forming apparatus structured as described above is as follows. That is, first, the peripheral surface of the photosensitive drum 10 is uniformly charged by the charge roller 20. Then, an electrostatic latent image, which reflects the image information regarding the first color, is formed on the peripheral surface of the photosensitive drum 10.

Next, the yellow developing apparatus 40Y for developing the electrostatic image which corresponds to the first color is moved into the position in which it directly opposes the photosensitive drum 10, and a yellow toner image, or an image formed of the toner of the first color, is formed on the peripheral surface of the photosensitive drum 10.

The yellow toner image, or the toner image of the first color, formed on the photosensitive drum 10, is transferred (primary transfer) onto the peripheral surface of the intermediary transfer member 50, in the above-mentioned primary transfer nip T1, through the process in which such voltage that is opposite in polarity to the toner is applied to the intermediary transfer member 50.

After the completion of the primary transfer process, the toner remaining on the peripheral surface of the photosensitive drum 10, that is, the toner which did not transfer from the photosensitive drum 10, is scraped away by the cleaning blade 101 of a cleaning apparatus 100, which is kept pressed upon the peripheral surface of the photosensitive drum 10. Then, electrical charge is removed from the photosensitive drum 10 by the charge removing apparatus 110, thereby preparing the photosensitive drum 10 for the next image formation. The toner scraped away from the peripheral surface of the photosensitive drum 10 by the cleaning blade 101 is sent to a waste toner bin 102.

The process similar to the above-described process for forming the toner image of the yellow color, or the first color, is repeated for the second, third, and fourth colors, that is, magenta, cyan, and black colors, thereby sequentially transferring in layers magenta, cyan, and black monochromatic toner images onto the peripheral surface of the intermediary transfer member 50. As a result, an unfixed full-color image is effected on the peripheral surface of the intermediary transfer member 50 by the unfixed yellow, magenta, cyan, and black monochromatic toner images deposited in layers on the peripheral surface of the intermediary transfer member 50.

These monochromatic toner images different in color are transferred (secondary transfer) all at once onto the surface of the transfer medium 80, in the second transfer nip T2 between the surface of the intermediary transfer member 50 and the surface of the secondary transfer roller 60. The transfer medium 80 is sent to the secondary transfer nip T2 from a feeding station (unshown).

After the secondary transfer, the peripheral surface of the intermediary transfer member 50 is cleaned by a cleaning apparatus 120; the toner remaining on the peripheral surface of the intermediary transfer member 50, that is, the toner which was not transferred, is scraped away by the cleaning blade 121 of the cleaning apparatus 120, which is kept pressed upon the peripheral surface of the intermediary transfer member 50. Then, the toner scraped away from the peripheral surface of the intermediary transfer member 50 is sent to a waste toner bin 122. After the cleaning operation, the intermediary transfer member 50 is used for the next image transfer process in which the monochromatic toner images different in color are transferred in layers.

After the completion of the second transfer, or the process in which the four unfixed monochromatic toner images different in color are transferred onto the transfer medium 80, the transfer medium 80 is conveyed to a fixing apparatus 90, in which it is introduced into the fixation nip N between a fixing member 91 and a pressuring member 92. In the fixation nip N, heat and pressure are applied to the transfer medium 80 and the unfixed toner images thereon. As a result, the unfixed toner images become permanently fixed to the transfer medium 80. After coming out of the fixation nip N, the transfer medium 80 is discharged as an intended color print into a delivery tray or the like by a pair of discharge rollers (unshown).

[Description of Charge Roller Cleaning Operation]

Next, referring to FIGS. 2 and 3, the cleaning operation of the charge roller 20 will be described.

Figure 2:
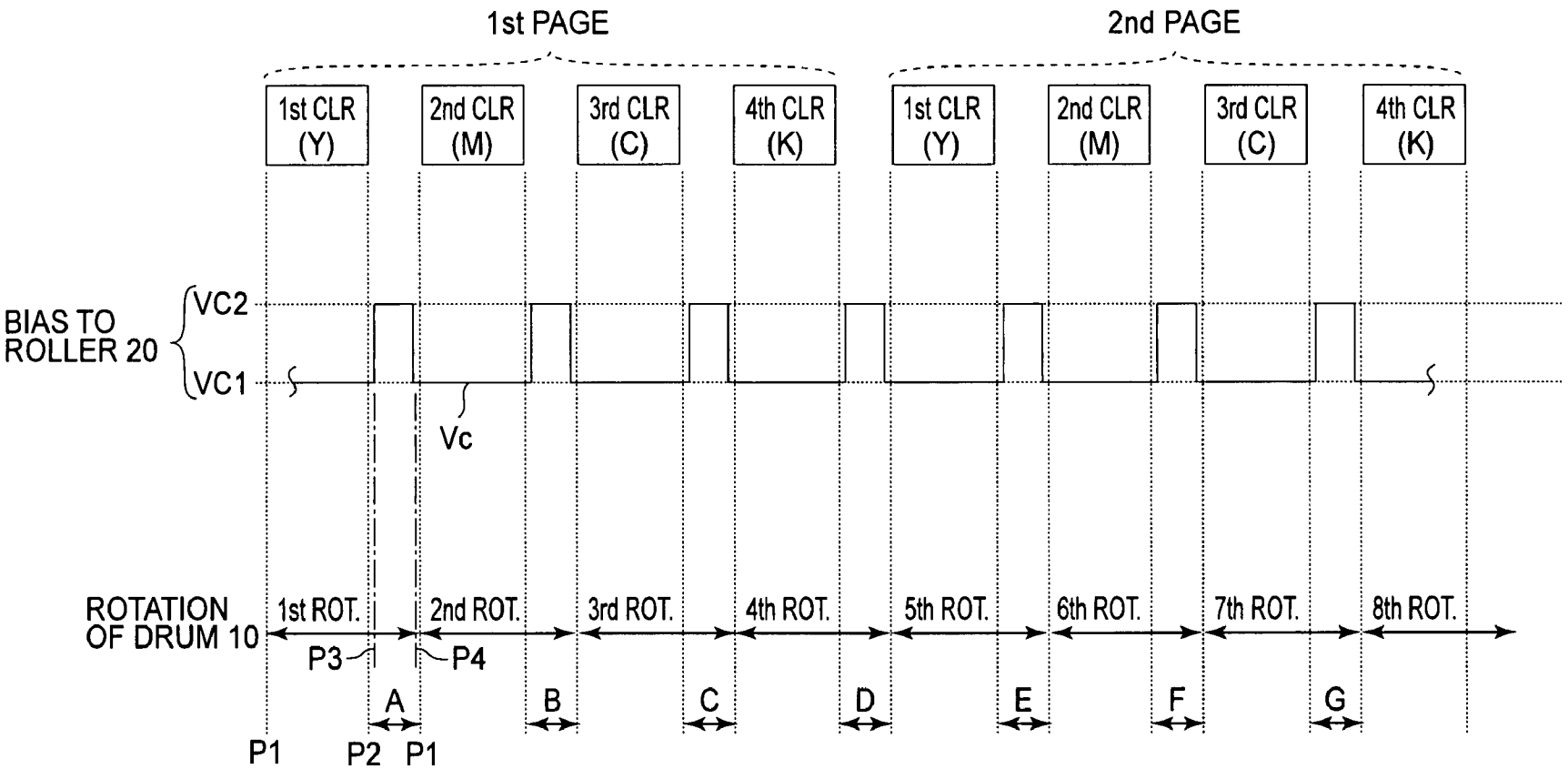
FIG. 2 is a diagram depicting the bias applied to the charge roller of the image forming apparatus in FIG. 1.

FIG. 2 shows the bias Vc applied to the charge roller 20 while two full-color images are successively printed on two transfer mediums, one for one. The optical image of a full-color image is separated in color into four optical monochromatic images different in color (primary color). FIG. 2 diagrammatically shows the various biases applied to the charge roller 20 while a total of eight electrostatic latent images are formed, that is, four electrostatic latent images are formed to form the yellow, magenta, cyan, and black monochromatic toner images for the first page, and four electrostatic latent images are formed to form the yellow, magenta, cyan, and black monochromatic toner images for the second page.

Figure 3:
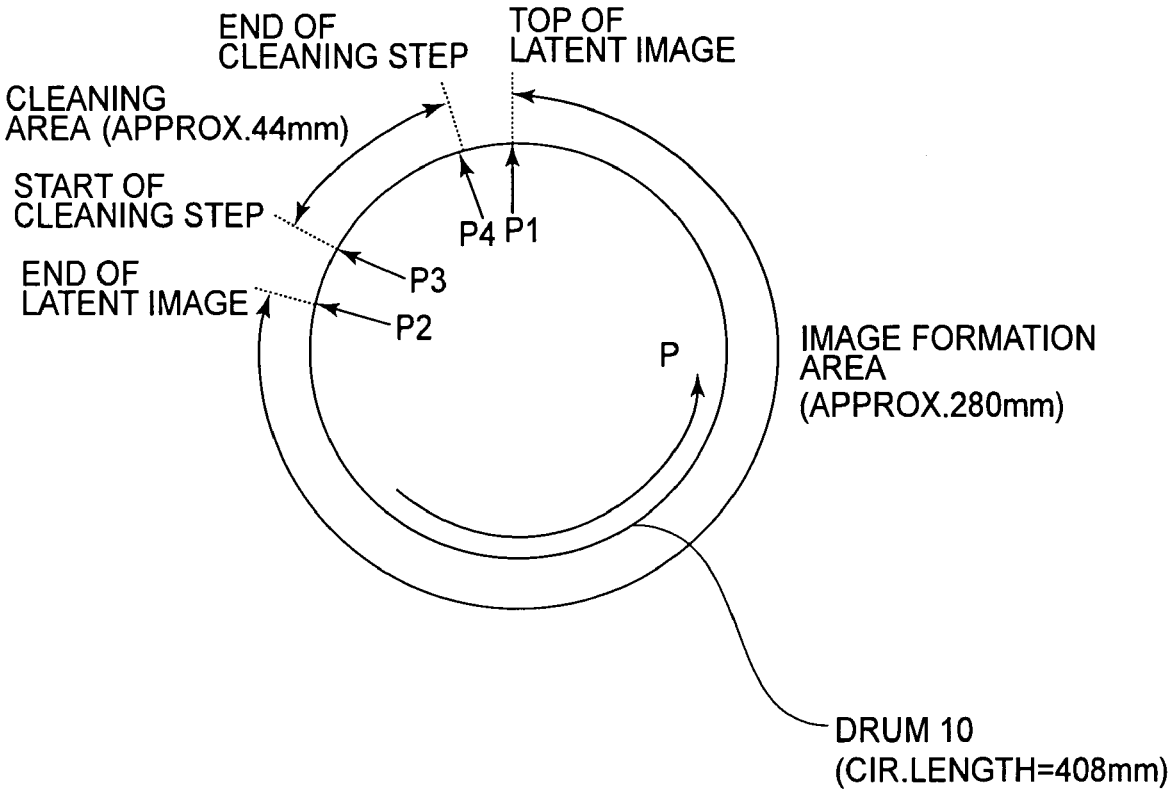
FIG. 3 is a schematic drawing showing the image formation area and charge roller cleaning area of the photosensitive drum in the first embodiment.

FIG. 3 is a schematic drawing showing the image formation area and charge roller cleaning area of the rotationally driven photosensitive drum 10. A symbol Vc1 represents the bias applied to the charge roller 20 to form an electrostatic latent image in accordance with the image information. In this embodiment, a DC bias of −1,000 V is applied to the charge roller 20 to charge the peripheral surface of the photosensitive drum 10 to a potential level of roughly −500 V. A symbol Vc2 represents the bias applied to the charge roller 20 to transfer the adherent substances such as the toner and other foreign substances having adhered to the charge roller 20, onto the peripheral surface of the photosensitive drum 10 while no image is being formed (while no toner image is formed). In this embodiment, a DC bias of roughly +200 V is applied.

First, the steps in the process for forming a full-color image on the first page, or the first sheet of transfer medium 80, will be described.

In order to form a yellow monochromatic image, the photosensitive drum 10 begins to be rotationally driven in the counterclockwise direction indicated by the arrow mark P, while applying the bias Vc1 to the charge roller 20 from the charge bias application power source 71 (FIG. 1). As a result, the peripheral surface of the photosensitive drum 10 begins to be uniformly charged. The uniformly charged area of the peripheral surface of the photosensitive drum 10 is scanned (exposed) by the beam of laser light L projected from the exposing apparatus 30. As a result, an electrostatic latent image is formed on the photosensitive drum 10. Referring to FIG. 3, the position of the leading edge of this electrostatic latent image corresponds to the point designated by a referential symbol P1, and the position of the trailing edge of the electrostatic latent image corresponds to the point designated by a referential symbol P2. That is, the process for forming an electrostatic latent image on the peripheral surface of the photosensitive drum 10 by the exposing apparatus 30 is carried out with the use of the area of the peripheral surface of the photosensitive drum 10, which is the area between the points P1 and P2. In terms of the circumferential direction of the photosensitive drum 10, the length of the image formation area is roughly 280 mm, and corresponds to the length of the transfer medium 80 in terms of the recording medium conveyance direction. The electrostatic latent image formed on the image formation area is developed by the yellow developing apparatus (first developing apparatus) 40Y into a yellow toner image (first developer image).

As the process for developing the electrostatic latent image into the yellow toner image ends, the magenta developing apparatus (second developing apparatus) begins to develop the electrostatic latent image on the photosensitive drum 10 into a magenta toner image (second developer image), starting from the point P1 coinciding with the leading edge of the latent image. During the interval from the point P2 coinciding with the trailing edge of the yellow toner image to the point P1 coinciding with the leading edge of the magenta toner image, that is, in the interval A in FIG. 2, the charge bias application power source 71 switches the bias applied to the charge roller 20, from the bias Vc1 to the bias Vc2. As described above, the interval between the points P2 and P1 is the interval between the period in which the toner image of the first color is formed, and the period in which the toner image of the second color is formed, that is, the interval which corresponds to the interval between the two developer images being sequentially formed on the peripheral surface of the photosensitive drum 10. The area of the peripheral surface of the photosensitive drum 10, which corresponds to this interval is the area which is not used for toner image formation. That is, no toner image is formed on this area of the peripheral surface of the photosensitive drum 10 during the formation of a full-color image made up of four monochromatic toner images different in color. The above-mentioned switching of the charge bias is triggered by a bias switching signal sent to the charge bias application power source 71 with a preset timing. Referring to FIG. 3, the point corresponding to the time at which the charge bias is to be switched from the bias Vc1 to the bias Vc2 is designated by a reference character P3 (cleaning start point), and the point corresponding to the time at which the charge bias is to be switched from the bias Vc2 to the bias Vc1 is designated by a reference character P4 (cleaning end point). The area from point P3 to point P4 is the cleaning area. In terms of the circumferential direction of the photosensitive drum 10, the distance between the cleaning start point P3 to the cleaning end point P4 is roughly 44 mm, which matches the circumference of the charge roller 20. In other words, the area from the cleaning start point P3 to the cleaning end point P4 is the charge roller cleaning area. In other words, the charge roller cleaning area is at least a part of the area from point P2 to point P1 in which the photosensitive drum 10 is not used for image formation. In the case of a structural arrangement in which a charge roller is rotated by the rotation of a photosensitive drum, the length of the charge roller cleaning area of the peripheral surface of the photosensitive drum is desired to be rendered longer than the circumference of the charge roller, because rendering the former longer than the latter ensures that the entirety of the peripheral surface of the charge roller is cleaned.

Incidentally, described above is the cleaning operation carried out in the interval between the formation of the yellow toner image and the formation of the magenta toner image, in order to clean the charge roller. Therefore, the yellow and magenta developing apparatuses were referred to as the first and second developing apparatuses, respectively. However, in the case of the cleaning operation carried out in the interval between the formation of the magenta toner image and the formation of the cyan toner image, the magenta developing apparatus is referred to as the first developing apparatus, whereas the cyan developing apparatus is referred to as the second developing apparatus, as they will be later.

Next, the process of cleaning a charge roller with the electric field generated between the charge roller and a photosensitive drum will be described. The electric field is generated between the charge roller 20 and photosensitive drum 10 by applying to the charge roller 20 such a bias that is on the plus side relative to the electrical charge of the photosensitive drum 10 in terms of potential level value. In this embodiment, the bias Vc2 is a positive bias, and is roughly 200 V. The toner and other foreign substances having adhered to the charge roller 20 are likely to carry a positive charge. Therefore, the toner and other foreign substances having adhered to the peripheral surface of the charge roller 20 can be efficiently transferred onto the charge roller cleaning area of the peripheral surface of the photosensitive drum 10, by the electric field generated by applying bias Vc2 to the charge roller 20. Incidentally, in this embodiment, a positive bias is applied to the charge roller 20. However, the bias to be applied to the charge roller 20 does not need to be limited to a positive bias. That is, a negative bias may be applied to the charge roller 20 as long as the foreign substances adhering to the charge roller 20 can be transferred onto the photosensitive drum 10 by the electric field generated between the charge roller 20 and photosensitive drum 10.

As the photosensitive drum 10 is rotated, the yellow toner image formed on the image formation area of the peripheral surface of the photosensitive drum 10 is transferred (primary transfer) onto the peripheral surface of the intermediary transfer member 50, in the primary transfer nip T1 (FIG. 1).

Meanwhile, as the photosensitive drum 10 is rotated, the adherent substances transferred onto the charge roller cleaning area of the photosensitive drum 10 are scraped away by the cleaning blade 101 of the cleaning apparatus 100, and are stored in a waste toner bin 102.

After the formation of the yellow toner image, the electrostatic latent image for the formation of the magenta toner image is formed. In order to ensure that where the leading edge of the latent image for the magenta toner image will be on the peripheral surface of the photosensitive drum 10 (point P1 in FIG. 3) coincides with where the leading edge of the latent image for the yellow toner image was on the peripheral surface of the photosensitive drum 10 (also point P1 in FIG.

3), this process of forming the electrostatic latent image for the magenta toner image is started exactly one full rotation of the photosensitive drum 10 after the completion of the yellow toner image. The charge bias is switched to the bias Vc1 for forming the magenta toner image. The area of the peripheral surface of the photosensitive drum 10, in which the latent image for the magenta toner image is formed, is the same area of the peripheral surface of the photosensitive drum 10, in which the latent image for the yellow toner image was formed, that is, the area of the peripheral surface of the photosensitive drum 10 between the point P1 coinciding with the position of the leading edge of the latent image and the point P2 coinciding with the position of the trailing edge of the latent image. The electrostatic latent image for the magenta toner image formed on this image formation area is developed into the magenta toner image by the magenta developing apparatus 40M.

After the development of the latent image for the formation of a magenta toner image, the charge bias application power source 71 switches the bias to be applied to the charge roller 20, from the bias Vc1 to the bias Vc2, at the point P2, and keeps it in the interval B (FIG. 2) between the point P2 corresponding to the trailing edge of the latent image for the yellow toner image and the point P1 corresponding to the leading edge of the latent image for the magenta toner image. As a result, the toner and other foreign substances having adhered to the charge roller 20 while no image is formed, are transferred onto the charge roller cleaning area of the peripheral surface of the photosensitive drum 10.

As the photosensitive drum 10 is further rotated, the magenta toner image formed on the image formation area of the peripheral surface of the photosensitive drum 10 is transferred (primary transfer) onto the peripheral surface of the intermediary transfer member 50, in the primary transfer nip T1 (FIG. 1), so that it is overlaid on the yellow toner image.

Meanwhile, as the photosensitive drum 10 is rotated, the adherent substances transferred onto the charge roller cleaning area of the peripheral surface of the photosensitive drum 10 are scraped away by the cleaning blade 101 of the cleaning apparatus 100, and are stored in the waste toner bin 102.

Similarly, the cyan and black toner images are formed on the image formation area of the peripheral surface of the photosensitive drum 10 (FIG. 3). Then, the adherent substances such as the toner and other foreign substances are transferred onto the cleaning area of the peripheral surface of the photosensitive drum 10, by switching the bias applied to the charge roller 20, from the bias Vc1 to the bias Vc2, by the charge bias application power source 71, at the point P2, and keeping the bias Vc2 during the intervals C and D (FIG. 2) between point P2 corresponding to the trailing edge of a latent image, and point P1 corresponding to the leading edge of a latent image.

As the photosensitive drum 10 is further rotated, the cyan and black toner images formed on the image formation area of the peripheral surface of the photosensitive drum 10 are sequentially transferred (primary transfer) onto the peripheral surface of the intermediary transfer member 50, in the primary transfer nip T1 (FIG. 1), so that they are overlaid on the yellow and magenta toner images. Meanwhile, as the photosensitive drum 10 is further rotated, the adherent substances transferred onto the cleaning area of the peripheral surface of the photosensitive drum 10 after the development of the latent images for the formation of the cyan and black toner images, are scraped away by the cleaning blade 101 of the cleaning apparatus 100, and are stored in the waste toner bin 102.

This ends the operation for forming a full-color image on the first page. As described above, it is desired that the four latent images are the same in the position of the leading edge, because as long as the four latent images are the same in the position of the leading edge, even if the photosensitive drum 10 is deviated in the position of its rotational axis, the multiple monochromatic toner images remain the same in the amount of elongation or shrinkage, making unlikely the formation of an image suffering from color deviation.

The steps for forming a full-color image on the second transfer medium are the same as those described above. That is, yellow, magenta, cyan, and black monochromatic toner images are formed on the image formation area of the peripheral surface of the photosensitive drum 10. Then, after the formation of these toner images, the adherent substances such as the residual toner and other foreign substances are transferred onto the cleaning area of the peripheral surface of the photosensitive drum 10, by switching the bias from Vc1 to Vc2, at the beginnings of the intervals E, F, and G, respectively.

[Cleaning Operation in Continuous Print Mode and Cleaning Operation in Transfer Medium Interval]

Described above is the cleaning operation carried out when a full-color image is synthetically formed of four monochromatic toner images different in color; the cleaning operation was carried out during the three intervals (intervals A-C during formation of monochromatic images on first page, and intervals E-G during formation of four monochromatic images on second page) among the four processes for forming the four latent images for the formation of four toner images different in color. In this section, the cleaning operation to be carried out during each of the recording medium intervals (paper intervals) which occur when multiple copies are continuously produced. Incidentally, hereafter, the above-mentioned interval between any sequential two processes for forming two monochromatic toner images different in color, one for one, will be referred to as color interval.

As soon as the formation of the toner image (first developer image) of the black color, or the last color, on the first page, or the first transfer medium, is completed, the cleaning operation is carried out during the interval corresponding to the area of the peripheral surface of the photosensitive drum 10 extending from the point P2 corresponding to the trailing edge of the latent image for the black toner image to the point P1 corresponding to the leading edge of the latent image for the formation of the toner image (second developer image) of the yellow color, or the first color, for the second page, or the second recording medium. That is, the cleaning operation is carried out during the interval between the process for forming the black monochromatic image for forming the full-color image for the first page, and the process for forming the yellow monochromatic toner image for forming the full-color image for the second page. More specifically, at the beginning of the interval D in FIG. 2, the charge bias application power source 71 switches the bias to be applied to the charge roller 20, from Vc1 to Vc2. Thereafter, it switches the charge bias from Vc2 to Vc1, in order to begin forming the electrostatic latent image for the formation of the toner image of the yellow color, or the first color, for the second page, at the same point (P1 in FIG. 3) on the peripheral surface of the photosensitive drum 10 as the position of the leading edge (P1 in FIG. 3)of the latent image for the formation of the toner image of the black color, or the last color, for the first page, that is, the point of the peripheral surface of the photosensitive drum 10 at which the electrostatic latent image for the formation of the black toner image for the first page, began to be formed exactly one full rotation of the photosensitive drum 10 prior to the beginning of the formation of the yellow toner image for the second page.

As described above, the cleaning operation is carried out during the color intervals A-C in the formation of the monochromatic images for the first page, during the paper interval D between the first and second pages, and during the color intervals E-G in the formation of the monochromatic toner images for the second page, with the use of the area of the peripheral surface of the photosensitive drum 10, in which no toner image is formed.

In this embodiment, in order to form a single full-color image per page, four electrostatic latent images are individually and sequentially formed on the image formation area of the peripheral surface of the photosensitive drum 10. Here, the operation for cleaning the charge roller 20 is carried out during each of the three color intervals (intervals A, B, and C in FIG. 2). Therefore, the charging performance of the charge roller 20 is maintained at a satisfactory level from the beginning of the formation of the monochromatic toner image of the first color to the end of the formation of the monochromatic toner image of the fourth color. More specifically, in this embodiment of the present invention, the area (cleaning area) of the peripheral surface of the photosensitive drum 10, onto which the adherent substances are transferred from the charge roller 20 by the charge roller cleaning operation, does not overlap with the image formation area of the peripheral surface of the photosensitive drum 10, and therefore, the charge roller 20 remains free from the adhesion of the toner and other foreign substances. Therefore, the charge roller 20 remains stable in charging performance. Further, it is possible to prevent the operation for cleaning the charge roller 20, from affecting the area of the peripheral surface of the photosensitive drum 10, in which the monochromatic toner images different in color are formed. Therefore, the monochromatic toner images different in color, which are formed on the transfer medium 80 while the charge roller 20 is cleaned as described above, is higher in quality.

As the voltage to be applied to the charge roller 20 is switched in the cleaning operation, the photosensitive drum 10 changes in the potential level. Thus, when the photosensitive drum 10 is charged for the formation of the next latent image, a memory sometimes occurs; the photosensitive drum 10 sometimes fails to be charged to the normal potential level for latent image formation. The memory which occurs when such voltage that is opposite in polarity to the photosensitive drum 10 is applied to the charge roller 20 is conspicuous, that is, the photosensitive drum 10 sometimes fails to be charged to a desired potential level, therefore allowing toner to adhere to the photosensitive drum 10, across the area on which an image is not formed. However, in this embodiment, even if the cleaning operation causes the photosensitive drum 10 to be charged to a potential level different from the desired one, the area of the peripheral surface of the photosensitive drum 10, which will become charged to the potential level different from the desired one is such an area of the peripheral surface of the photosensitive drum 10 that is not used for the formation of toner images. Therefore, it does not occur that the cleaning operation causes the formation of an inferior image.

Further, the operation for cleaning the charge roller 20 is carried out during the paper interval D between the first and second pages with the use of the area of the peripheral surface of the photosensitive drum 10, which is not used for actual image formation. Therefore, the paper interval D does not need to be increased to satisfactorily clean the charge roller 20, preventing the cleaning operation from reducing the image forming apparatus in printing speed. If the cleaning operation is carried out differently from this embodiment, that is, if the cleaning operation is carried out without using the area of the peripheral surface of the photosensitive drum 10, which is not used for image formation, it becomes necessary to extend the paper interval D long enough to prevent the cleaning operation from affecting the toner image which will be formed next.

In this embodiment, however, the cleaning operation is designed to be carried out during the above-mentioned three intervals A, B, and C, with the use of the area of the peripheral surface of the photosensitive drum 10, which is not used for image formation (area in which a toner image is not formed). Therefore, the possibility that the memory which results from the cleaning operation will affect the monochromatic toner images, different in color, to be formed after the cleaning operation, is eliminated. Therefore, it does not occur that inferior monochromatic toner images are formed. Thus, this embodiment can improve a full-color image forming apparatus structured as described above, in terms of the level of quality at which it forms a full-color image.

Further, in this embodiment, when multiple monochromatic toner images different in color are continuously formed to form multiple full-color images on multiple pages, one for one, the cleaning operation is carried out in the interval D, which is the interval between the consecutive two pages. Therefore, the area of the peripheral surface of the photosensitive drum 10, onto which the adherent substances are transferred from the charge roller 20 by the cleaning operation (charge roller cleaning area of the peripheral surface of the photosensitive drum 10) does not overlap either with the area of the peripheral surface of the photosensitive drum 10, in which the electrostatic latent image for the formation of the toner image of the last color for the preceding page is formed, or the area of the peripheral surface of the photosensitive drum 10, in which the electrostatic latent image for the formation of the toner image of the first color for the following page is formed. Therefore, not only does the charge roller 20 remain free of adherent substances such as toner and foreign substances, and therefore remaining uniform in charging performance from the first to the last pages, but also, the cleaning operation is prevented from affecting the memory of the peripheral surface of the photosensitive drum 10. Therefore, this embodiment can prevent the formation of the monochromatic toner images of inferior quality. Therefore, it can improve a full-color image forming apparatus in image quality.

Embodiment 2

Figure 4:
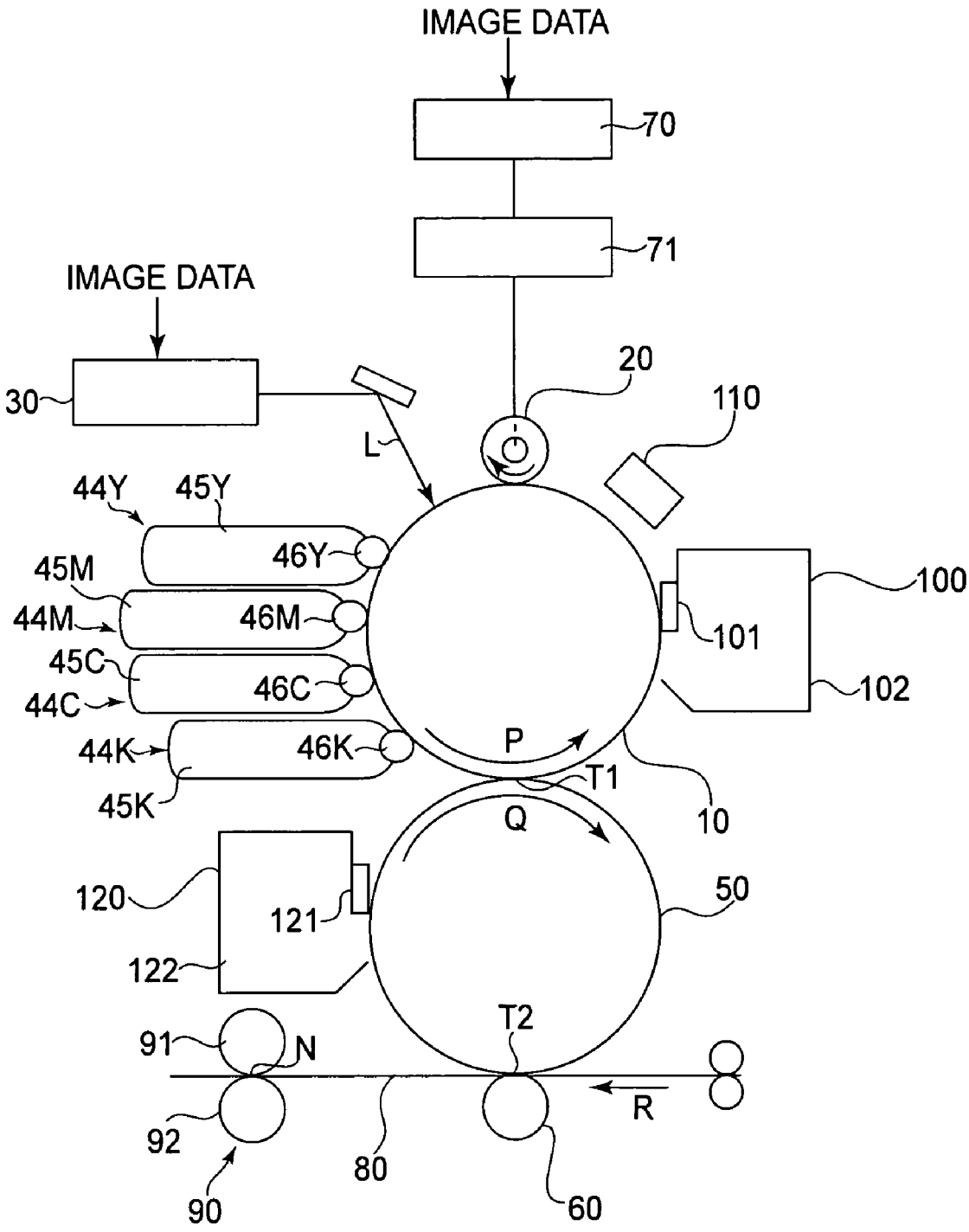
FIG. 4 is a schematic drawing of the image forming apparatus in a second embodiment of the present invention.

FIG. 4 is a schematic drawing of the image forming apparatus in a second embodiment of the present invention. The components, parts, etc., of the image forming apparatus in this embodiment, which are designated by the same reference numerals and characters as those used to describe the first embodiment, are the same as the components, parts, etc., of the image forming apparatus in the first embodiment. Therefore, they will not be described here to avoid the repetition of the same descriptions.

In the case of the image forming apparatus in this embodiment, the developing apparatuses 44 (44Y, 44M, 44C, and 44B) for developing yellow, magenta, cyan, and black colors, respectively, are disposed in the adjacencies of the peripheral surface of the photosensitive drum 10. The four electrostatic latent images for forming four monochromatic toner images different in color, one for one, are sequentially formed one by one on the peripheral surface of the photosensitive drum 10, are developed by the corresponding developing apparatuses 44, and are transferred onto an intermediary transfer member 50 so that the four monochromatic toner images are placed in layers on the intermediary transfer member 50. The charging method, first transferring method, second transferring method, fixing method, etc., employed by the image forming apparatus in this embodiment are the same as those employed by the image forming apparatus in the first embodiment. Therefore, they will not be described.

The developing apparatuses 44 are provided with development rollers 46 (46Y, 46M, 46C, and 46B) disposed in the corresponding developing devices 45 (45Y, 45M, 45C, and 45B) in which yellow, magenta, cyan, and black toners are stored, respectively. In this embodiment, each of the developing apparatuses is disposed so that the development roller 46 is in contact, or virtually in contact, with the peripheral surface of the photosensitive drum 10. The method employed in this embodiment to form a monochromatic toner image is such that an electrostatic latent image is formed on the peripheral surface of the photosensitive drum 10, and the toner borne on the peripheral surface of the development roller 46 is supplied to the electrostatic latent image on the peripheral surface of the photosensitive drum 10, by applying a preset development bias to the development roller 46.

The image forming apparatus in this embodiment is different from that in the first embodiment in that the developing apparatuses 40 in the first embodiment can be completely moved away from the development station in which the electrostatic latent image on the photosensitive drum 10 is developed, whereas the developing apparatuses 44 in this embodiment are always kept in contact, or virtually in contact, with the peripheral surface of the photosensitive drum 10, whether or not they are being used for developing the electrostatic latent image on the photosensitive drum 10.

[Description of Cleaning Operation]

The image formation area (FIG. 3) and cleaning area (FIG. 3) of the peripheral surface of the photosensitive drum 10 in the image forming apparatus, in this embodiment, and the control (FIG. 2) for switching the bias to be applied to the charge roller 20, in this embodiment, are the same as those in the first embodiment. That is, the bias being applied to the development roller 46 is turned off before the charge roller cleaning area of the peripheral surface of the photosensitive drum 10 reaches the development roller 46 of the developing apparatus 44. This step is taken to prevent toner from scattering in an image forming apparatus, such as the image forming apparatus in this embodiment, in which the development rollers are in contact, or virtually in contact, with the photosensitive drum. That is, if the same bias as the development bias is continuously applied to the development roller even after the area of the peripheral surface of the photosensitive drum 10, the potential level of which has been rendered lower than the normal one by the cleaning operation, reached the development roller, it is possible that toner will jump from the development roller 46 to the photosensitive drum 10. Thus, this problem of toner jumping from the development roller 46 to the photosensitive drum 10 is solved by turning off the bias being applied to the development roller 46, before the charging roller cleaning area of the peripheral surface of the photosensitive drum 10 reaches the development roller 46 of the developing apparatus 44.

[Effects of Cleaning Operation]

The image forming apparatus in this embodiment can also offer the same effects as those offered by the image forming apparatus in the first embodiment.

Further, this embodiment can prevent the problem that the interior of the main assembly of an image forming apparatus is contaminated by toner because the toner jumps from the development rollers onto the photosensitive drum 10.

Embodiment 3

Next, referring to FIGS. 5 and 6, the image forming apparatus in another embodiment of the present invention will be described.

Figure 5:
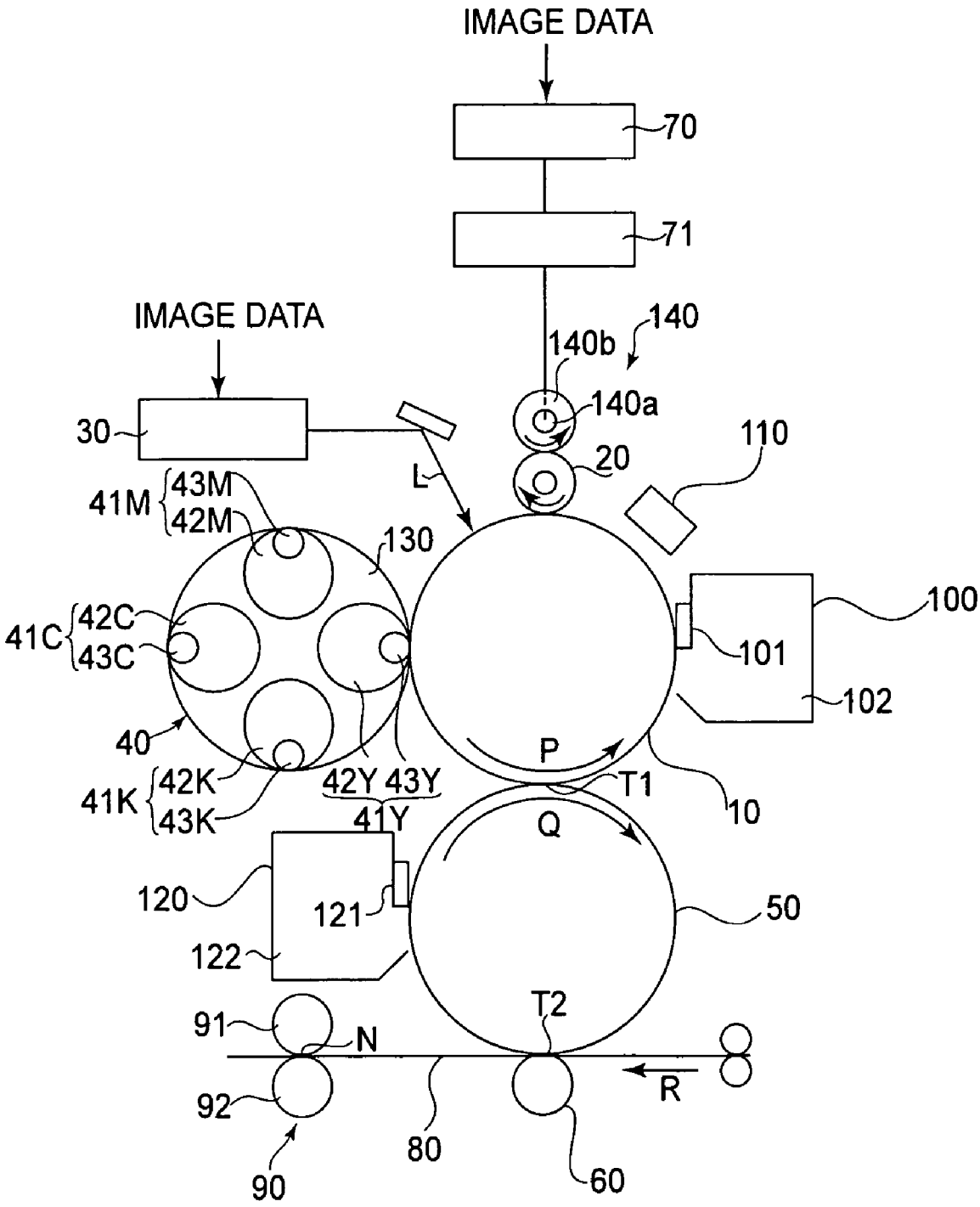
FIG. 5 is a schematic drawing of the image forming apparatus in a third embodiment of the present invention.
Figure 6:
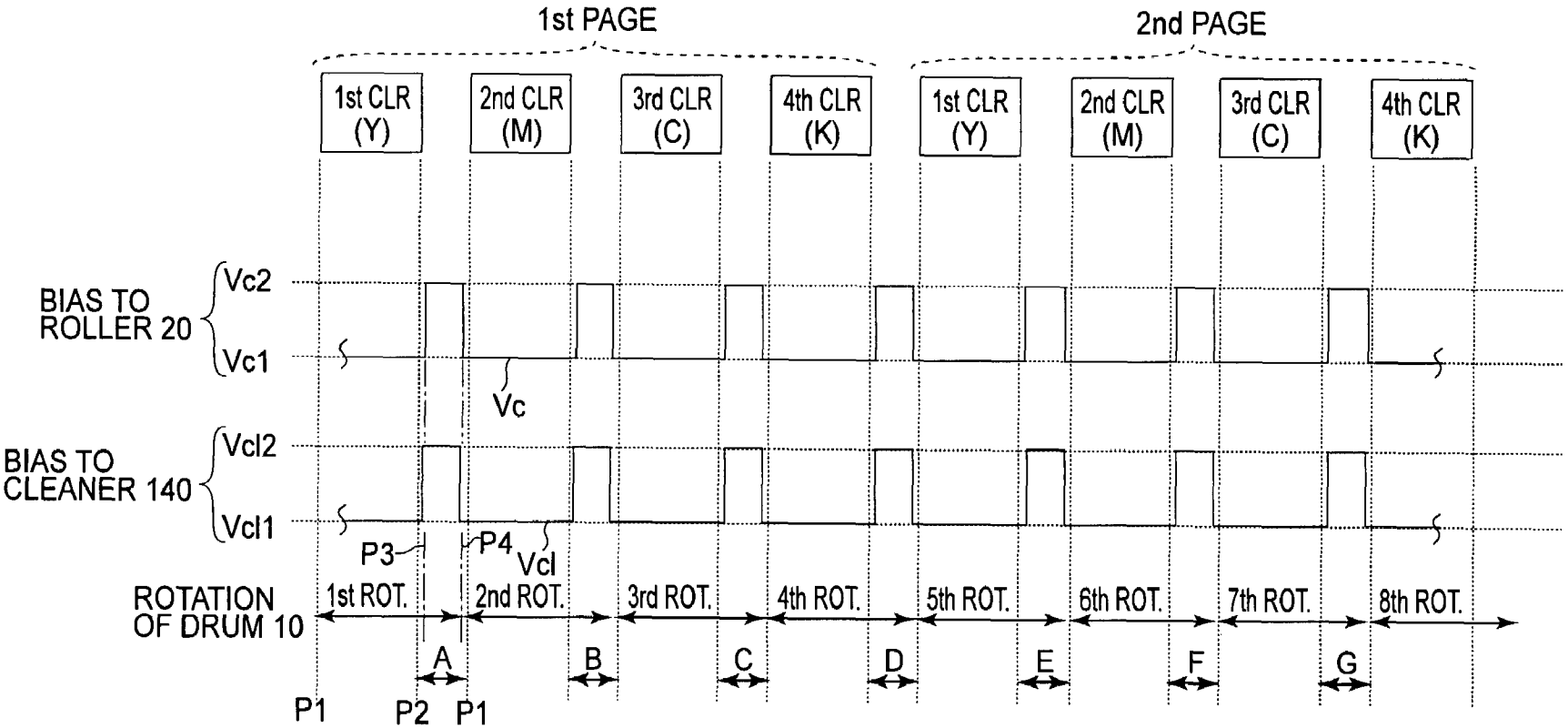
FIG. 6 is a diagram depicting the bias applied to the charge roller of the image forming apparatus in FIG. 5.

FIG. 5 is a schematic drawing of the image forming apparatus in a third embodiment of the present invention. In FIG. 5, designated by a reference numeral 140 is a charge roller cleaner (which hereinafter will be referred to as charge roller cleaning member) as a cleaning means for cleaning the charge roller 20. The components, parts, etc., of the image forming apparatus in this embodiment, which are designated by the same reference numerals and characters as those used in FIG. 1, are identical to the components, parts, etc., of the image forming apparatus in FIG. 1. Therefore, they will not be described here to avoid the repetition of the same descriptions. FIG. 6 is a diagram describing the control of the bias Vc to be applied to the charge roller 20 when sequentially printing two full-color images on two transfer mediums, one for one, and the bias Vc1 to be applied to the charger roller cleaning member 140. The intervals, points, etc., in FIG. 6, which are the same as those in FIG. 2, are given the same referential symbols as those in FIG. 2, and they will not be described to avoid the repetition of the same descriptions.

As the charge roller cleaning member 140, an elastic roller made up of an electrically conductive metallic core 140*a*, and an elastic layer 140*b* formed around the peripheral surface of the metallic core 140*a*, of foamed rubber, is employed. The charge roller cleaning member 140 is kept pressed at the lengthwise ends of the metallic core 140*a* by a pressure applying means (unshown) such as a pair of compression springs or the like so that the peripheral surface of the elastic layer 140*b* formed of foamed rubber (which hereinafter will be referred to as peripheral surface of charge roller cleaning member 140) is kept in contact with the peripheral surface of the charge roller 20. The circumference of the charge roller cleaning member 140 is the same as that of the charge roller 20. The charge roller cleaning member 140 is given the function of recovering from the charge roller 20, the toner and foreign substances having adhered to the charge roller 20, in the interface between the charge roller cleaning member 140 and charge roller 20. To the metallic core 140*a*, a DC bias is applied from the charge bias application power source 71. The charge roller cleaning member 140 is rotated by the rotation of the charge roller 20 while uniformly charging the peripheral surface of the charge roller 20 to the potential level proportional to a preset DC bias applied to the metallic core 140*a*.

[Description of Cleaning Operation]

Next, referring to FIG. 6, the charge roller 20, and the bias to be applied to the charge roller cleaning member 140, will be described.

The third embodiment is similar to the first and second embodiments in that the charge roller 20 is cleaned in the intervals A-G, and that the same area of the peripheral surface of the photosensitive drum 10 is used as the charge roller cleaning area regardless of in which interval the cleaning operation is carried out.

When the toner image of yellow color, or the first color, is formed for the formation of a full-color image on the first page, or the first transfer medium 80, the charge bias application power source 71 applies the bias Vc1 (=−1,000V) and $Vc1_1$ to the charge roller 20 and charge roller cleaning member 140, respectively. The value of the bias $Vc1_1$ is the same as that of the bias Vc1 applied to the charge roller 20 ($Vc1_1$=−1,000V).

After the formation of the monochromatic yellow toner image, the charge bias application power source 71 changes the bias applied to the charge roller 20 and the bias applied to the charge roller cleaning member 140, at the beginning of the interval A, which corresponds to the area of the peripheral surface of the photosensitive drum 10, which extends from the point P2 corresponding to the trailing edge of the latent image for the immediately preceding yellow toner image, to the point P1 (FIG. 3) corresponding to the leading edge of the toner image of magenta color, or the second color. That is, it switches the bias applied to the charge roller 20 from the bias Vc1 to a bias Vc2 (=+200V) at the beginning of the interval A, and then, from the bias Vc2 to the bias Vc1 at the end of the interval A. Also in the same interval, it switches the bias applied to the charge roller cleaning member 140 from the bias $Vc1_1$ to the bias $Vc1_2$, and then, from the bias $Vc1_2$ to the bias $Vc1_1$. The switching of the above-mentioned biases are carried out by the charge bias application power source 71 in response to a switching command signal outputted to the charge bias application power source 71, with preset timing, by the charge control portion 70, based on the image formation data. The value of the bias $Vc1_2$ is on the plus side of the value of the bias applied to the charge roller 20, by 100V ($Vc1_2$=+300V).

Thereafter, while the charge roller 20 is in contact with the image formation area (FIG. 3) of the peripheral surface of the photosensitive drum 10, which is used for forming the monochromatic magenta, cyan, and black toner images, the charge bias application power source 71 applies the biases Vc1 and $Vc1_1$ to the charge roller 20 and charge roller cleaning member 140, respectively. During the intervals B and C, which are the color intervals for the first page, during the interval D which is the paper interval between the first and second pages, and during the intervals E-G which are the color intervals for the second page, the charge bias application power source 71 applies the biases Vc2 and $Vc1_2$ to the charge roller 20 and charge roller cleaning member 140, respectively.

[Effects of Cleaning Operation]

In this embodiment, when forming a monochromatic toner image on the image formation area of the peripheral surface of the photosensitive drum 10, the adherent substances such as toner and other foreign substances recovered by the charge roller cleaning member 140 are transferred onto the charge roller 20 with the use of the difference in potential level between the charge roller cleaning member and charge roller. After being transferred onto the charge roller 20, the adherent substance such as the toner and other foreign substances are transferred onto the cleaning area of the peripheral surface of the photosensitive drum 10. In other words, the toner and other foreign substances recovered onto the charge roller cleaning member 140 are transferred onto the photosensitive drum 10 by way of the charge roller 20.

With the employment of the above-described arrangement, the cleaning performance of the charge roller cleaning member 140 can be maintained at the optimal level, and therefore, the charge roller 20 can be kept free of the adherent substances such as the toner and other foreign substances, thereby being kept constant in charging performance at the optimal level. Further, the same area of the peripheral surface of the photosensitive drum 10 is used as the charge roller cleaning area regardless of which interval the cleaning operation is carried out in. Therefore, the cleaning operation is prevented from affecting the memory of the peripheral surface of the photosensitive drum 10. Therefore, it does not occur that the cleaning operation results in the formation of an inferior image. Therefore, the image forming apparatus can be improved in the level of quality at which it forms a multicolor image.

[Miscellanies]

An image bearing member to which the present invention is applicable is not limited to a photosensitive drum. For example, the present invention is applicable to an image bearing member in the form of an endless belt, which is made up of a substrate layer, and a photosensitive layer formed on the outward surface of the substrate layer, of an organic photosensitive substance. Further, the present invention is also applicable to an image bearing member made up of a dielectric substance, which is not photoconductive.

In the preceding embodiments, the circumference of the photosensitive drum was rendered greater than the dimension of the transfer medium in terms of the transfer medium conveyance direction, so that the peripheral surface of the photosensitive drum is provided with an area in which neither the toner image of the first color, nor the toner image of the second color, are formed. Here, the dimension of the transfer medium in terms of the transfer medium conveyance direction is desired to refer to the dimension of the longer edge of the longest transfer medium usable with an image forming apparatus, because as long as the circumference of the photosensitive drum is rendered greater than the dimension of the longer edge of the longest transfer medium, it is assured that when a transfer medium shorter in terms of the transfer medium conveyance direction than the longest transfer medium, the area in which no toner image is formed is effected on the peripheral surface of the photosensitive drum.

Also in the preceding embodiments, the multiple monochromatic toner images sequentially formed on the photosensitive drum are transferred onto the intermediary transfer member, and then, are transferred all at once from the intermediary transfer member onto a transfer medium. However, the application of the present invention is not limited to this image forming process. That is, the present invention is also applicable to an image forming process which directly transfer onto a transfer medium the multiple monochromatic toner images sequentially formed on the photosensitive drum.

Also in the preceding embodiments, the charge roller was cleaned by applying to the charge roller such bias that causes the positively charged foreign substances to be expelled from the charge roller. However, the application of the present invention is not limited to this charge roller cleaning method. For example, the present invention is also applicable to a charge roller cleaning method which applies such bias that cause the negatively charged foreign substances to be expelled. What is important here is that a charge roller is cleaned with the use of the area of the peripheral surface of a photosensitive drum, other than the area in which a developer image is formed.

Further, in the preceding embodiments, the charge roller was cleaned in all the color intervals. However, the application of the present invention is not limited to this cleaning method. What is necessary here is that a cleaning operation such as the above-described one is carried out in one of the color intervals. Further, it is unnecessary to carry out the cleaning apparatus in every paper interval; the cleaning operation has only to be carried out every preset number of paper intervals.

Further, the area of the peripheral surface of the photosensitive drum, which is not used for image formation, and onto which the foreign substances are to be expelled, is desired to be always the same area of the peripheral surface of the photosensitive drum. However, this is not mandatory. That is, it does not need to be always the same area of the peripheral surface of the photosensitive drum, as long as it does not occur that the charge memory is effected by the charge roller cleaning operation, and/or that the foreign substances expelled from the charge roller affect the formation of the next toner image. For example, assuming that an area A of the peripheral surface of a photosensitive member becomes the area which are not used for image formation in a given image forming operation for continuously forming multiple copies, the area of the peripheral surface of the photosensitive drum, which will become the area which is not used form image formation, in an image forming apparatus carried out thereafter, may be an area B, that is, an area different from the area A.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 107435/2005 and 063956/2006 filed Apr. 4, 2005 and Mar. 9, 2006 which are hereby incorporated by reference.

What is claimed is:

1. An image forming apparatus comprising:

an image bearing member;

a charging member for contacting a peripheral surface of said image bearing member to electrically charge the peripheral surface;

a first developing device for forming a first developed image on the peripheral surface of said image bearing member charged by said charging member;

a second developing device for forming a second developed image on the peripheral surface, wherein a combined developed image is formed by superimposing the first developed image and the second developed image on a common transfer material, wherein when the combined image is being formed, said charging member is cleaned by transferring, by an electric field, material deposited on said charging member to a region between said first developed image and said second developed image on the peripheral surface of said image bearing member, and wherein said first developed image and said second developed image are not formed in the region.

2. An image forming apparatus according to claim 1, further comprising a bias voltage application device for applying a bias voltage of a predetermined potential to said charging member, wherein a bias voltage applied to said charging member when a region of said image bearing member in which a developed image is going to be formed contacts said charging member and a bias voltage applied to said charging member when a region of said image bearing member in which the cleaning is going to be effected contacts said charging member, are made different from each other by switching.

3. An image forming apparatus according to claim 2, wherein a polarity of the applied bias voltage applied to said charging member when the region of said image bearing member in which the cleaning is going to be effected contacts said charging member and a polarity of the applied bias voltage applied to said charging member when a region of said image bearing member in which a developed image is going to be formed contacts said charging member, are different from each other.

4. An apparatus according to claim 1, wherein said charging member includes a charging roller, and wherein a circumferential length of the region in which the cleaning is effected on said image bearing member is longer than a full circumferential length of said charging roller.

5. An apparatus according to claim 1, further comprising a cleaning member for contacting and cleaning said charging member, wherein the deposited material is transferred through said charging member onto the region.

6. An apparatus according to claim 5, wherein a potential difference between said cleaning member and said charging member during a cleaning operation is different from a potential difference therebetween during a charging operation of said charging member.

7. An apparatus according to claim 1, wherein a leading end of said first developed image and a leading end of said second developed image are at the same position on said image bearing member.

8. An image forming apparatus according to claim 1, wherein when a developed image is formed continuously on the transfer material, all of the regions between the developed images are at the same region of said image bearing member.

9. An image forming apparatus according to claim 1, wherein when the region which is between the developed images and which has been subjected to a cleaning operation is in a developing position, developing bias voltages applied to said first developing device and said second developing device are shut off.

10. An image forming apparatus comprising:

an image bearing member;

a charging member for contacting a peripheral surface of said image bearing member to electrically charge the peripheral surface;

a first developing device for forming a first developed image on the peripheral surface of said image bearing member charged by said charging member;

a second developing device for forming a second developed image on the peripheral surface, wherein said first developing device forms a first developed image to be transferred onto a first transfer material, and said second developing device forms a second developed image to be formed on a second transfer material, and wherein when a developed image is formed continuously on the first transfer material and the second transfer material, wherein when the combined image is being formed, said charging member is cleaned by Transferring, by an electric field, material deposited on said charging member to a region between said first developed image and said second developed image on the peripheral surface of said image bearing member, and said first developed image and said second developed image are not formed in the region.

11. An apparatus according to claim 10, wherein a bias voltage application device for applying a bias voltage of a predetermined potential to said charging member, wherein a bias voltage applied to said charging member when a region of said image bearing member in which a developed image is going to be formed contacts said charging member and a bias voltage applied to said charging member when a region of said image bearing member in which the cleaning is going to be effected contacts said charging member, are made different from each other by switching.

12. An apparatus according to claim 11, wherein a polarity of the applied bias voltage applied to said charging member when the region of said image bearing member in which the cleaning is going to be effected contacts said charging member and a polarity of the applied bias voltage applied to said charging member when a region of said image bearing member in which a developed image is going to be formed contacts said charging member, are different from each other.

13. An apparatus according to claim 10, wherein said charging member includes a charging roller, and wherein a circumferential length of the region in which the cleaning is effected on said image bearing member, is longer than a full circumferential length of said charging roller.

14. An apparatus according to claim 10, wherein a cleaning member for contacting and cleaning said charging member, wherein the deposited material is transferred through said charging member onto the region.

15. An apparatus according to claim 10, wherein a potential difference between said cleaning member and said charging member during a cleaning operation is different from a potential difference therebetween during charging operation of said charging member.

16. An apparatus according to claim 10, wherein a leading end of said first developed image and a leading end of said second developed image are at the same position on said image bearing member.

17. An apparatus according to claim 10, wherein when the developed images are continuously formed on the transfer material, all of unused regions are at the same region of said image bearing member.

18. An apparatus according to claim 10, wherein when the region which is between the developed images and which has been subjected to a cleaning operation is in a developing position, developing bias voltages applied to said first developing device and said second developing device are shut off.

* * * * *